United States Patent [19]

Thorneburg

[11] 4,373,361

[45] Feb. 15, 1983

[54] SKI SOCK WITH INTEGRALLY KNIT THICKENED FABRIC AREAS

[76] Inventor: James L. Thorneburg, P.O. Box 5440, Statesville, N.C. 28677

[21] Appl. No.: 253,708

[22] Filed: Apr. 13, 1981

[51] Int. Cl.[3] ..... A41B 11/00; D04B 9/46

[52] U.S. Cl. ..... 66/178 R; 66/183; 66/185; 66/186; 66/196; 2/241

[58] Field of Search ..... 66/178 R, 178 A, 182, 66/183, 184, 185, 186, 187, 49, 194, 196; 2/239, 241

[56] References Cited

U.S. PATENT DOCUMENTS

| | | | |
|---|---|---|---|
| 3,793,851 | 2/1974 | Thorneburg | 66/185 |
| 3,796,067 | 3/1974 | East | 66/178 R |
| 4,057,981 | 11/1977 | Runae | 66/185 |
| 4,104,892 | 8/1978 | Thorneburg | 66/185 |
| 4,172,370 | 10/1979 | Safrit | 66/178 R X |
| 4,194,249 | 3/1980 | Thorneburg | 66/182 |
| 4,277,959 | 7/1981 | Thorneburg | 66/187 |

*Primary Examiner*—Ronald Feldbaum

*Attorney, Agent, or Firm*—Bell, Seltzer, Park & Gibson

[57] ABSTRACT

Each embodiment of the ski sock of the present invention includes additional yarn knit in plated relationship with the body yarns to form a thickened fabric area extending down the front portion of the leg of the sock to cushion and protect the front portion of the leg of the wearer from discomfort caused by the front and upper edge of the ski boot. The ski sock also includes a thickened fabric area extending along the rear half of the sock and at least through the heel and sole area to cushion and protect the heel and lower portion of the foot of the wearer. Opposite side panels of thinner fabric are provided between the thickened fabric areas in the front and rear of the sock to reduce the bulk of the fabric. The thinner fabric areas may provide increased stretchability to these areas and to permit the sock to be easily drawn onto and off of the foot and to readily conform to the foot of the wearer. Stretch restricting opposite side panels are provided in the lower portion of the foot, that portion of the foot adapted to fit over the forward portion of the foot and up to the medial portion of the ball of the foot, to limit the stretchability and to provide a snug fit on the forward end of the foot of the wearer.

30 Claims, 16 Drawing Figures

SKI SOCK WITH INTEGRALLY KNIT THICKENED FABRIC AREAS

FIELD OF THE INVENTION

This invention relates generally to a ski sock with additional yarn knit in selected portions of the sock, and forming thickened fabric areas therein, and more particularly to such a sock wherein a thickened fabric area is formed in the front portion of the leg to cushion and protect the front of the leg of the wearer from discomfort caused by the front and upper edge of the ski boot. It is also preferred that additional yarn be knit in the heel and sole to cushion and protect the heel and lower portion of the foot of the wearer.

BACKGROUND OF THE INVENTION

It is known to provide various types of padding in the leg portions of socks to be worn with ski boots for cushioning and protecting the leg of the wearer against chafing and abrasion by the ski boot. For example, U.S. Pat. No. 3,003,154 discloses the use of foamed or sponge material sewn in position around the ankle portion of a sock. Also, U.S. Pat. No. 4,008,350 discloses the use of a fabric covered foam "collar" sewn in position around the ankle of the sock. However, the foamed or sponge material disclosed in these socks is so thick and bulky that it may interfere with the removal and replacement of the sock and/or the ski boot. Also, the separate operation of sewing this material to the sock leg increases the cost of producing the socks.

U.S. Pat. No. 3,995,322 discloses the use of terry loops to provide a cushion top for a sock particularly adapted to be worn with ski boots. The sock of this patent has terry loops formed completely around the leg portion and the terry loops terminate above the heel pocket. The terry loops are provided for the purpose of preventing chafing of the leg of the wearer by the upper edge of the ski boot. The terry loops in this sock extend completely around the inside of the leg so that the leg is bulky and the additional yarn forming the terry loops tends to limit stretchability of the leg.

SUMMARY OF THE INVENTION

With the foregoing in mind, it is an object of the present invention to provide a ski sock with additional yarn knit in the front half of the leg of the sock and providing a thickened fabric area extending along the front of the leg of the wearer to cushion and protect the front portion of the leg from discomfort caused by the ski boot.

The thickened fabric area in the front portion of the leg limits stretchability of this portion of the sock and, in order to alleviate this problem, areas adjacent opposite sides of the thickened fabric area are knit of body yarn only to provide substantially greater stretchability than the stretchability of the thickened fabric area. These opposite side areas of greater stretchability provide sufficient stretchability to the leg so that the sock may be easily drawn onto and removed from the foot and leg of the wearer and so that the sock will readily conform to the configuration of the leg of the wearer.

The present ski sock also includes additional yarn knit in plated relationship with the body yarn in the heel, sole and instep of the foot to provide thickened fabric areas to cushion and protect these areas of the foot of the wearer. These thickened fabric areas in the heel, sole and instep limit stretchability of these portions of the foot of the sock. In order to provide sufficient stretchability to the foot of the sock so that the sock may be easily drawn onto and removed from the foot of the wearer, the body yarn only is knit in opposite side panels extending between the thickened fabric area in the heel and sole and the thickened fabric area in the instep. Since these opposite side panels are knit of the body yarn only, they provide substantially greater stretchability than the stretchability of the thickened fabric areas in the heel, sole and instep.

In certain embodiments, the additional yarn forming the thickened fabric areas is knit with the body yarn to form terry loop cushioning therein. In other embodiments, the additional yarn is knit in plated relationship with the body yarn to form plain stitch fabric, without forming terry loops. When the additional yarn is knit in plated relationship with the body yarn, either forming terry loops or plain stitch loops, the stretchability of the thickened fabric areas is substantially restricted by the knitting of the additional yarn and the adjacent areas knit only of the body yarn are necessary to provide sufficient stretchability to the sock that the sock may be easily drawn onto and removed from the leg and foot of the wearer. In order to limit stretchability of the portion of the foot of the sock adjacent the toe, it has been found desirable to knit additional yarn in plated relationship with the body yarn in the portions of the opposite side panels which extend back to about the middle of the ball of the foot of the wearer. Thus, the thickened fabric area extends completely around the forward end of the foot of the sock and limits the stretchability so that the forward end of the sock snugly engages the forward end of the foot of the wearer.

The thickened fabric areas in the front and rear of the ski sock of the present invention are formed by simply knitting additional yarn in these areas so that the cost of manufacture is not materially increased and the sock is finished by merely closing the toe end of the sock. The ski sock is preferably knit with body yarn which includes a hydrophilic yarn knit in plated relationship with a hydrophobic yarn and with the hydrophilic yarn being positioned primarily on the inner surface of the sock so that perspiration and moisture is absorbed and wicked from the foot of the wearer and to the outside of the sock where it is evaporated. The additional yarns forming the thickened fabric cushion areas may include hydrophilic, hydrophobic, or combinations of these yarns, which aid in absorbing and wicking the moisture from the foot of the wearer.

In one embodiment of the ski sock of the present invention, the thickened fabric area in the front half of the sock extends throughout the length of the leg and instep while the thickened area in the rear half of the sock extends from a point just above the heel and throughout the sole of the sock. Terry loops are formed of the additional yarn in both the front and rear halves of the sock. A single set of terry loops is formed in the heel, sole and instep while two sets of terry loops are formed in the front of the leg.

In another embodiment of the ski sock of the present invention, the thickened fabric area also extends throughout the length of the leg and instep of the sock in the front half and in the heel and sole of the rear half. The additional yarn forms two sets of terry loops in the front half of the leg while a single additional yarn is knit in plated relationship with the body yarn and forms plain stitch fabric in the thickened fabric area in the instep. The additional yarn also forms a single set of terry loops in the heel and sole of the sock.

In another embodiment of the ski sock of the present invention, the thickened fabric area in the front half of the leg of the sock includes two sets of terry loops while the additional yarn is knit in plated relationship with the body yarn and forms plain stitch fabric in the instep. The additional yarn is knit in plated relationship with the body yarn and forms a thickened fabric area of plain stitch fabric in the heel and sole of the rear half of the foot of the sock.

In yet another embodiment of the ski sock of the present invention, additional yarn is knit in plated relationship with the body yarn in the front portion of the leg and instep to form a thickened fabric area of plain stitch fabric throughout the length of the front of the sock. The additional yarn is also knit in plated relationship with the body yarn in the rear portion of the leg, the heel, and the sole of the sock to form a thickened fabric area of plain stitch fabric throughout the length of the rear of the sock. In this embodiment of the sock, the additional yarn does not form terry loops in any of the thickened fabric areas and provides a relatively light-weight ski sock, which will be preferred by some skiers.

BRIEF DESCRIPTION OF THE DRAWINGS

Other objects and advantages will appear as the description proceeds when taken in connection with the accompanying drawings, in which—

DESCRIPTION OF THE ILLUSTRATED EMBODIMENTS

Generally, in each of the embodiments of the ski sock illustrated, additional yarn is knit in plated relationship with the body yarn and forms a thickened fabric area extending along at least the front half of the leg to cushion and protect the front portion of the leg of the wearer from discomfort caused by the front and upper edge of the ski boot. Also, additional yarn is knit in plated relationship with the body yarn and forms a thickened fabric area extending along the rear half of the sock and at least throughout the heel and sole to cushion and protect the lower portion of the foot of the wearer. Areas adjacent opposite sides of the thickened fabric areas in the front and rear halves of the sock are knit of the body yarn only and define opposite side panels having substantially greater stretchability than the stretchability of the adjacent thickened fabric areas. The stretchability of the opposite side panels provide sufficient stretchability in the leg and foot of the sock to permit the sock to be easily drawn onto and off of the foot and to cause the sock to conform to the configuration of the leg and foot of the wearer. As described below, the additional yarn forms one or two sets of terry loops in certain thickened fabric areas and forms plain stitch fabric in other thickened fabric areas.

The ski sock illustrated in each of the embodiments is of the type generally referred to as a "tube" or heelless sock. However, it is to be understood that the cushioned thickened fabric areas may also be incorporated in a ski sock of the type having a reciprocated heel pocket knit therein.

EMBODIMENT OF FIGS. 1-5

Figure 3:
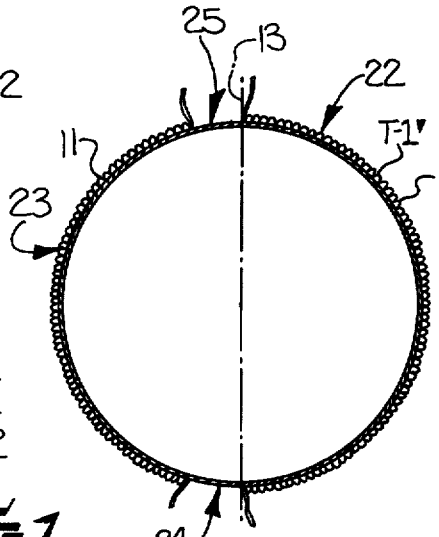
FIG. 3 is a somewhat schematic transverse sectional view taken substantially along the line 3—3 in FIG. 2 and showing the sock in a circular condition.

The ski sock includes an upper cuff 10 which may be of a true rib or mock rib construction and is integrally knit with the upper portion of the leg which includes a front half 11 and a rear half 12, illustrated in FIG. 3 as being divided by a center line 13. The leg is integrally knit with a foot including a heel area or portion 14, a toe 15, a sole 16, and an instep 17.

Figure 4:
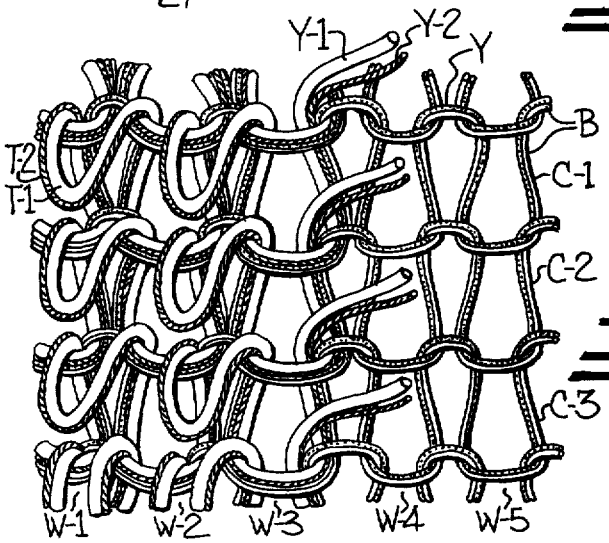
FIG. 4 is a greatly enlarged elevational view of a small area of the fabric, being taken substantially in the area of the dotted rectangle 4 in FIG. 2.
Figure 5:
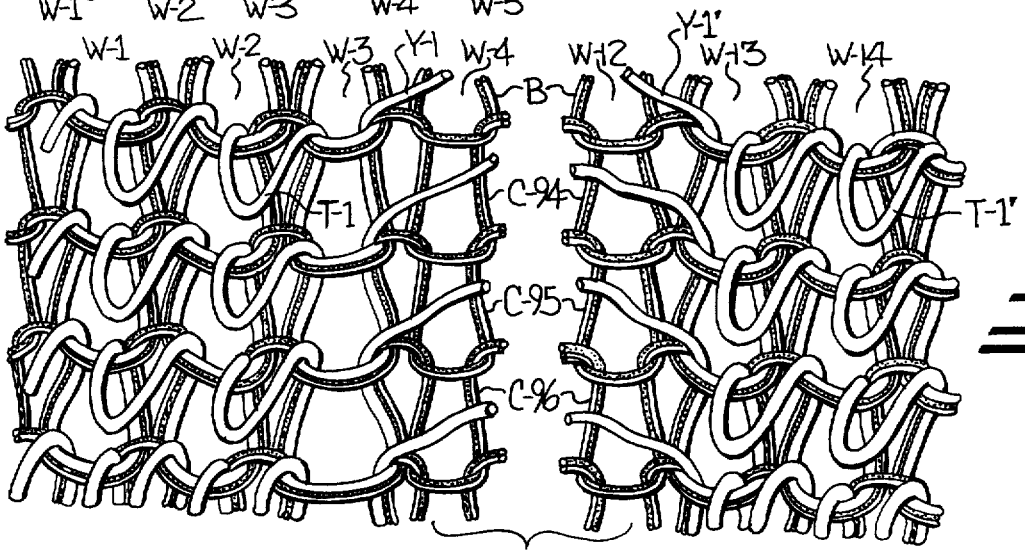
FIG. 5 is a view similar to FIG. 4 but being taken in the area of the dotted rectangle 5 in FIG. 2.

The leg and foot of the sock is knit throughout of at least one body yarn, illustrated as including a main body yarn B knit in plated relationship with an auxiliary body yarn Y (FIGS. 4 and 5). The main body yarn B is preferably hydrophobic yarn, such as nylon, which has been textured to impart stretchable characteristics thereto. The auxiliary body yarn Y is preferably a hydrophilic yarn, such as a blend of wool and silk, and is knit in plated relationship with the body yarn so that the auxiliary body yarn Y is positioned primarily on the inner surface of the sock while the main body yarn B is positioned primarily on the outer surface of the sock. To aid in identification, the auxiliary body yarn Y is speckled while the main body yarn B is plain, in FIGS. 4 and 5.

As illustrated in FIG. 4, additional yarns Y-1 and Y-2 are knit in plated relationship with the body yarns Y, B in needle wales W-1, W-2 and W-3 of courses C-1, C-2 and C-3 and form a thickened fabric area, broadly indicated at 21, in the front half 11 of the leg. The yarns Y-1 and Y-2 form respective first and second sets of terry loops T-1 and T-2 in the sinker wales of the thickened fabric area 21 in front half 11 of the leg of the sock. The additional yarn Y-1 is preferably a hydrophobic yarn, such as orlon, and the yarn Y-2 is a hydrophilic yarn, such as a blend of wool and silk. To aid in identification, the yarn Y-2 is striped in FIG. 4.

The sets of terry loops T-1 and T-2 are formed by feeding the additional yarns Y-1 and Y-2 above the nibs of terry sinkers and through chopping yarn feed fingers so that these yarns are fed to and removed and cut at opposite side edges of the thickened fabric area 21 in the front half 11 of the leg. The cut ends of the additional yarns Y-1 and Y-2 extend inside of the sock and at opposite side edges of the thickened fabric area 21 in the front half 11 of the leg, as shown in FIGS. 2 and 4.

Figure 2:
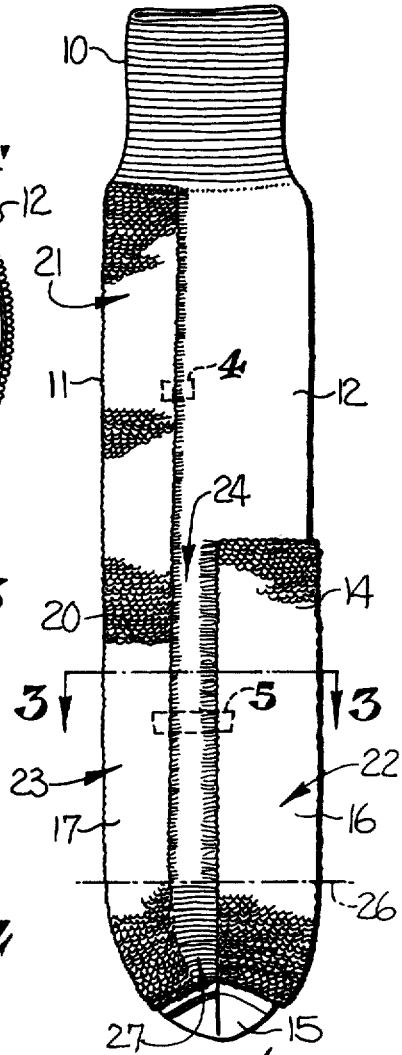
FIG. 2 is a side elevational view of the ski sock of FIG. 1, being shown in flattened and everted condition to clearly illustrate the areas in which the thickened fabric areas are provided in the sock.

As illustrated in FIG. 2, the sets of terry loops T-1 and T-2 in the thickened fabric area 21 extend from the cuff 10 and throughout the front portion of the leg and down to the top of the instep 17, at the line 20. Opposite side edges of the thickened fabric area 21 terminate short of the center line 13 of the leg, as shown in FIG. 3 and for purposes to be presently described, while the areas adjacent opposite side edges of the thickened fabric area 21 and the entire rear half 12 of the leg is illustrated as being knit with only the body yarns Y and B in plated relationship to form plain stitch fabric, without terry loops. If desired, one or both of the additional yarns Y-1 and Y-2 can be knit in plated relationship with the body yarns Y and B without forming terry loops in the areas adjacent opposite side edges of the thickened fabric area 21 and the entire rear half 12 of the leg. Since the areas adjacent opposite side edges of the thickened fabric area 21, and the entire rear half 12 of the leg of the sock, are devoid of terry loops, thinner fabric is provided in these areas to reduce the bulk of the fabric in the leg of the sock.

At the beginning of the heel 14, an additional yarn Y-1', such as orlon, (FIG. 5) is knit in plated relationship with the body yarns Y and B, as illustrated in wales W-13 and W-14 of courses C-94, C-95, and C-96 and forms a single set of terry loops T-1' in the sinker wales throughout the heel area 14. The additional yarn Y-1' is also knit in the sole area 16 and down to the toe area 15 to form terry loops in a thickened fabric area, boadly indicated at 22, which is provided to cushion and protect the lower portion of the foot and heel of the wearer.

The additional terry yarn Y-1' is fed above the nibs of terry sinkers and through a chopping yarn feed finger so that the yarn Y-1' is fed to and is removed and cut at the opposite sides of the thickened fabric area 22 in the heel 14 and sole 16. The cut ends of the terry yarn Y-1' extend inside of the sock and at opposite side edges of the thickened fabric area 22, as shown in the right-hand portion of FIG. 5. Opposite side edges of the thickened fabric area 22 terminate at the center line 13, as shown in FIG. 3, for purposes to be presently described.

When knitting the instep portion 17, below the line 20 in FIG. 2, the feeding of the additional yarn Y-2 is discontinued and a single set of terry loops T-1 (FIG. 5) is formed of the additional yarn Y-1 and in the sinker wales. The additional yarn Y-1 is knit in plated relationship with the body yarns B and Y in the needle wales W-1, W-2 and W-3 of courses C-94, C-95 and C-96. The single set of terry loops T-1 thus forms a terry cushioned thickened fabric area, broadly indicated at 23, extending throughout the instep 17 and from the line 20 to the toe 15. The thickened fabric area 23 cushions and protects the upper portion of the foot of the wearer but is not as thick and does not form as heavy a cushion as the thickened fabric area 21 in the front portion 11 of the leg, where a greater amount of protection is desirable for preventing chafing of the front of the leg by the upper edge of the ski boot.

When the ski sock of the present invention is knit on a circular hosiery knitting machine having 84 needles, it is preferred that the thickened fabric areas 21 and 23 be knit on the 26 needles which knit the medial portion of the front half 11 of the sock so that opposite side edges of the thickened fabric areas 21, 23 terminate eight needles short of the center line 13. The areas adjacent opposite side edges of the thickened fabric area 21 and the entire rear of the leg are plain stitch fabric, without terry loops, and are knit solely of the plated body yarns Y and B. It is also preferred that the thickened fabric area 22 in the heel 14 and the sole 16 be knit on the 42 needles which form the rear half 12 of the sock so that the terry loops extend to the center line 13 (FIG. 3).

Thus, as illustrated in FIG. 3, opposite side edges of the thickened fabric area 23 in the front half of the instep do not meet with and join opposite side edges of thickened fabric area 22 in the heel 14 and sole 16 to define opposite side panels, broadly indicated at 24 and 25 which are knit only of the body yarns Y and B. The knitting of the additional yarn Y-1 in the thickened fabric area 23 and the knitting of the additional yarn Y-1' in the thickened fabric area 22 limits the stretchability of these areas. If the opposite side edges of these thickened fabric areas 23, 22 were joined together at opposite sides of the foot of the sock, the stretchability of the foot of the sock would be limited to an extent where it would be difficult, if not impossible, to draw the sock onto and off of the foot and over the heel. Also, the sock would not have sufficient stretchability to readily conform to the configuration of the foot, after being placed thereon. Since the opposite side panels 24, 25 are knit solely of the body yarns B and Y, they provide substantially greater stretchability than the stretchability of the adjacent thickened fabric areas 22, 23 and permit the sock to be easily drawn onto and off of the foot.

Figure 1:
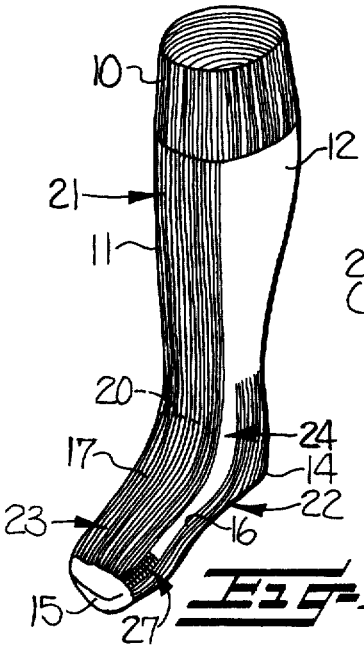
FIG. 1 is a perspective view of one embodiment of the ski sock, as it appears when positioned on the leg and foot of the wearer.

In order to limit the stretchability of the lower portion of the foot, that portion adjacent the toe and extending back to about the medial portion of the ball of the foot, the additional yarn is knit in plated relationship with the body yarns Y and B, without forming terry loops, in the lower portions of the stretchable opposite side panels 24, 25, as illustrated by the horizontal lines extending below the dash-dot line 26 in FIG. 2, to form stretch restricting opposite side panels, broadly indicated at 27 in FIGS. 1 and 2. In these stretch restricting side panels 27, three yarns are knit in plated relationship and form plain stitch fabric to restrict stretchability so that the lower portion of the foot, from about the middle of the ball of the foot through the toes, provides a snug fit on the forward portion of the foot of the wearer.

Embodiment of FIGS. 6–9

Figure 8:
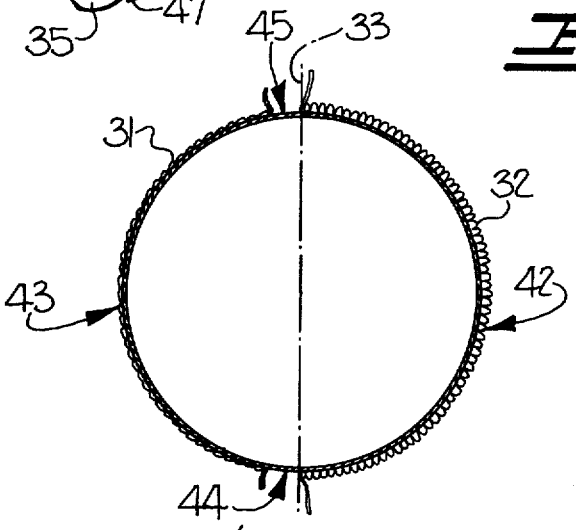
FIG. 8 is a somewhat schematic transverse sectional view being taken substantially along the line 8—8 in FIG. 7 and showing the sock in circular condition.

The ski sock includes an upper cuff 30 which may be of a true rib or mock rib construction and is integrally knit with the upper portion of the leg which includes a front half 31 and a rear half 32, illustrated in FIG. 8 as being divided by a center line 33. The leg is integrally knit with a foot including a heel area or portion 34, a toe 35, a sole 36, and an instep 37.

Figure 9:
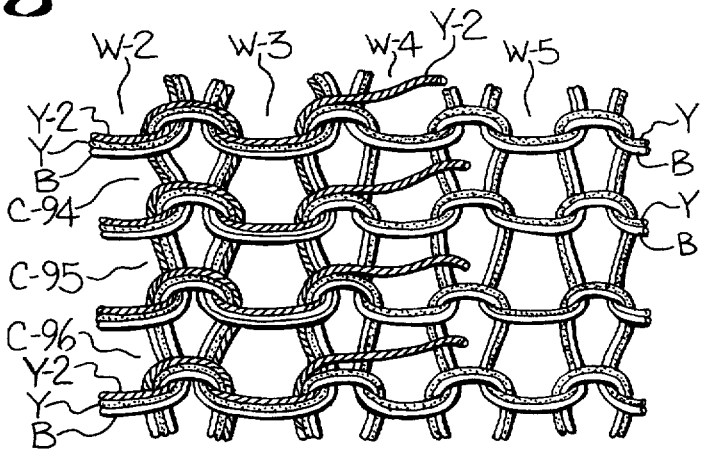
FIG. 9 is a greatly enlarged elevational view of the small area of the fabric, being taken substantially in the area of the dotted rectangle 9 in FIG. 7.

The leg and foot of the sock is knit throughout with a main body yarn B knit in plated relationship with an auxiliary body yarn Y (FIG. 9). The main body yarn B is preferably hydrophobic yarn, such as nylon, which has been textured to impart stretchable characteristics thereto. The auxiliary yarn Y is preferably a hydrophilic yarn, such as a blend of wool and silk, and is knit in plated relationship with the body yarn so that the auxiliary body yarn Y is positioned primarily on the inner surface of the sock while the main body yarn B is positioned primarily on the outer surface of the sock. To aid in identification, the auxiliary body yarn Y is speckled while the main body yarn B is plain, in FIG. 9.

Figure 7:
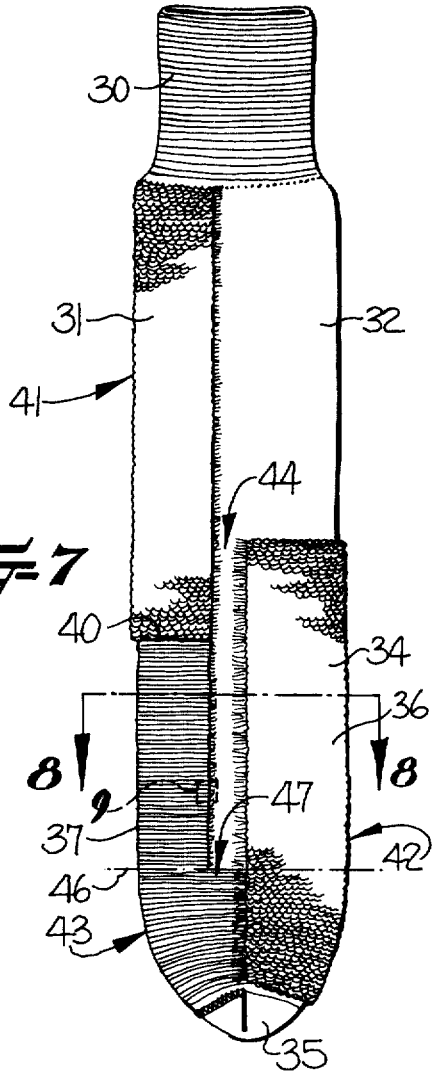
FIG. 7 is a side elevational view of the ski sock of FIG. 6, being shown in flattened and everted condition.

A thickened fabric area, broadly indicated at 41, extends from the cuff 30 and down the front portion of the leg to the line 40 in FIG. 7. This thickened fabric area 41 is knit in the same manner as the corresponding thickened fabric area 21 illustrated in FIGS. 1–5 to form two sets of terry loops in the thickened fabric area 41. Opposite side edges of the thickened fabric area 41 terminate eight needles short of the center line 33 while the areas adjacent opposite side edges of the thickened fabric area 41 and entire rear half 32 of the leg is knit with only the body yarns Y and B in plated relationship to form plain stitch fabric, without terry loops.

At the beginning of the heel 34, a single additional yarn, such as orlon, is knit in plated relationship with the body yarns Y and B and in the same manner as illustrated in the right-hand portion of FIG. 5, to form a single set of terry loops in the sinker wales throughout the heel area 34. The additional yarn is also knit in the sole area 36 and down to the toe 35 to form terry loops in a thickened fabric area, broadly indicated at 42, which is provided to cushion and protect the lower portion of the foot and heel of the wearer. Opposite side edges of the thickened fabric area 42 terminate at the center line 33, as shown in FIG. 8.

When knitting the instep portion 37, below the line 40 in FIG. 7, the feeding of the additional hydrophobic yarn is discontinued and the feeding of the additional hydrophilic yarn is continued, but without forming terry loops. This additional hydrophilic yarn, indicated at Y-2 in FIG. 9, is knit in plated relationship with the body yarns B and Y in both the needle wales W-2 and W-3 of courses C-94, C-95 and C-96 as well as in the sinker wales to form a thickened fabric area, broadly indicated at 43, of plain stitch fabric. The thickened fabric area 43 is the same width as the thickened fabric area 41 and extends throughout the instep 37 and from the line 40 to the toe 35. The cushioned thickened fabric area 43 cushions and protects the upper portion of the foot of the wearer but is not as thick and does not form as heavy a cushion as the thickened fabric area 41 in the front portion of the leg 31, where a greater amount of protection is desirable for preventing chafing and rubbing of the upper edge of the ski boot against the leg of the wearer.

When this embodiment of the ski sock of the present invention is knit on a circular hosiery knitting machine having 84 needles, it is preferred that the thickened fabric area 41 in the front half of the leg and the thickened fabric area 43 in the instep 37 be knit on the 28 needles which knit the medial portion of the front half 31 of leg. The six needles adjacent opposite sides of the thickened fabric areas 41, and the needles around the entire rear half 32 of the leg knit only the plated body yarns Y and B. The thickened fabric area 42 in the heel 34 and the sole 36 is knit on the 42 needles which form the rear half of the sock so that opposite sides of the thickened fabric area 42 terminate at the center line 33. Thus, as indicated in FIG. 8, stretchable opposite side panels, broadly indicated at 44, 45 are defined between the opposite side edges of the thickened fabric area 43 in the instep 37 and the thickened fabric area 42 in the heel 34 and sole 36.

The knitting of the additional yarn in the thickened fabric area 42 and the knitting of the additional yarn in the thickened fabric area 43 limits the stretchability of these areas and if the opposite side edges of these thickened fabric areas were joined together in the foot of the sock, the stretchability of the foot of the sock would be limited to such an extent that it would be difficult, if not impossible, to draw the sock onto and off of the foot and over the heel. Also, with limited stretchability, the sock would not readily conform to the foot, after being placed thereon. Since the opposite side panels 44, 45 are knit only of the body yarns Y and B, they provide substantially greater stretchability than the stretchability of the adjacent thickened fabric areas and permit the sock to be easily drawn onto and off of the foot.

Figure 6:
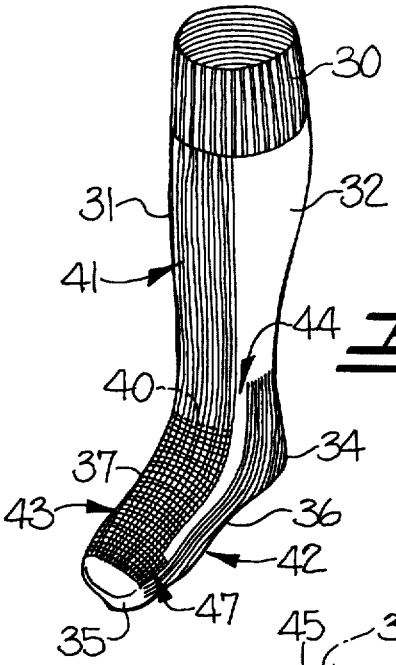
FIG. 6 is a perspective view of another embodiment of the ski sock, as it appears when positioned on the leg and foot of the wearer.

In order to limit the stretchability of the lower portion of the foot, that portion extending back from the toe to about the medial portion of the ball of the foot, an additional yarn is knit in plated relationship with the body yarns Y and B in the lower portions of the opposite side panels 44, 45, as illustrated by the horizontal lines extending below the dash-dot line 46 in FIG. 7, to form stretch restricting opposite side panels, broadly indicated at 47 in FIGS. 6 and 7. Thus, the additional yarn in the panels 47 limits the stretch in the area from about the middle of the ball of the foot and provides a snug fit on the forward end of the foot of the wearer.

Embodiment of FIGS. 10–13

Figure 12:
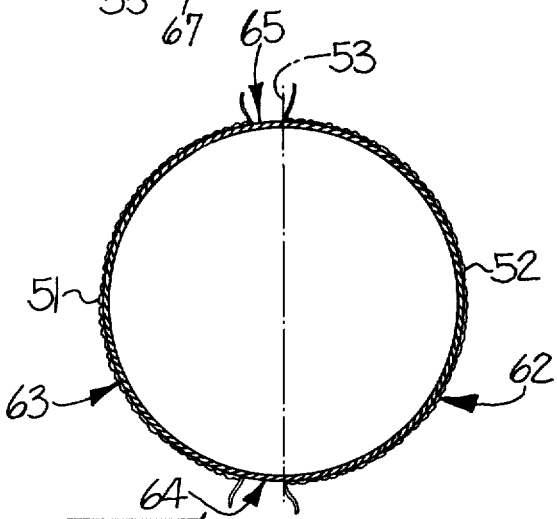
FIG. 12 is a somewhat schematic transverse sectional view taken substantially along the line 12—12 in FIG. 11 and showing the sock in circular condition.

The ski sock includes an upper cuff 50 which may be of a true rib or a mock rib construction and is integrally knit with the upper portion of the leg which includes a front half 51 and a rear half 52, illustrated in FIG. 12 as being divided by a center line 53. The leg is integrally knit with a foot including a heel area or portion 54, a toe 55, a sole 56, and an instep 57.

Figure 13:
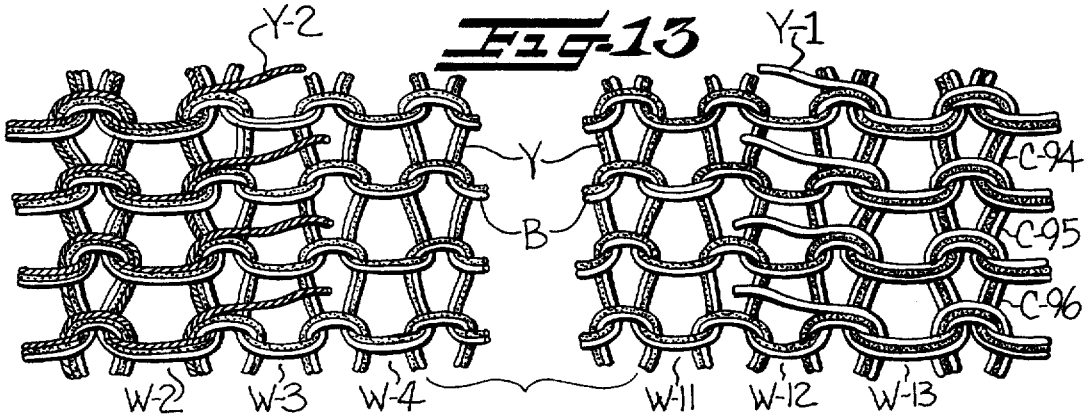
FIG. 13 is a greatly enlarged elevational view of a small area of the knit fabric, being taken substantially in the area of the dotted rectangle area 13 in FIG. 11.

The leg and foot of the sock is knit throughout with a main body yarn B knit in plated relationship with an auxiliary yarn Y (FIG. 13). The body yarn B and the auxiliary yarn Y are of the same type as the corresponding yarns described in the first two embodiments. Additional terry yarns are knit in plated relationship with the body yarns Y and B and form two sets of terry loops in the sinker wales of the front half 51 of the leg of the sock, in the same manner as illustrated in FIG. 4, to provide a thickened fabric area, broadly indicated at 61. The thickened fabric area 61 extends from the cuff 50 and throughout the front portion of the leg and down to the line 60 in FIG. 11. This thickened fabric area 61 terminates at opposite side edges eight wales short of the center line 53 and the adjacent wales and entire rear half 52 of the leg is knit solely with the body yarns Y and B in plated relationship.

At the beginning of the heel 54, an additional yarn Y-1 is knit in plated relationship with the body yarns Y and B, as illustrated in wale W-13 of courses C-94, C-95 and C-96 in the right-hand portion of FIG. 13. The additional yarn Y-1 is also knit in the sole area 56 and down to the toe area 55 to form a thickened fabric area, broadly indicated at 62, which is provided to cushion and protect the lower portion of the foot and heel of the wearer. The thickened fabric area 62 is plain stitch fabric, without terry loops, and opposite side edges terminate at the center line 53.

Figure 11:
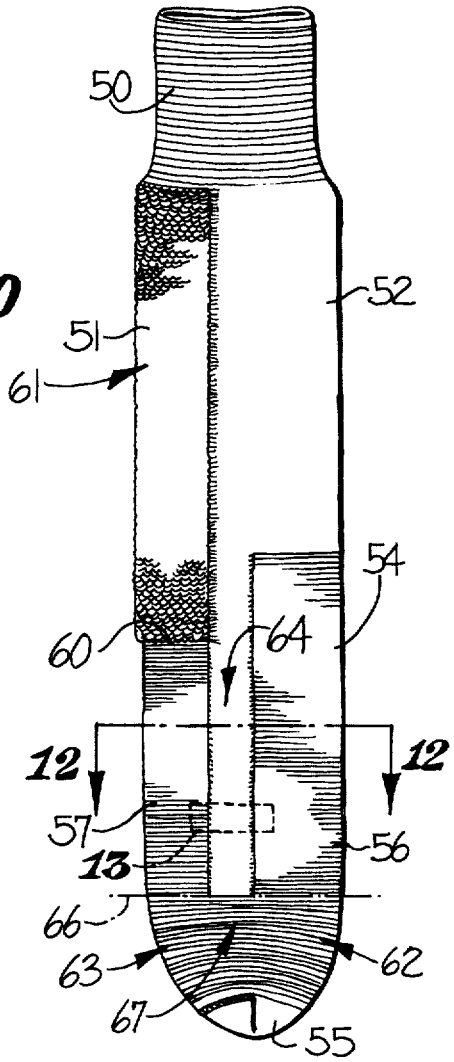
FIG. 11 is a side elevational view of the sock of FIG. 10, being shown in flattened and everted condition.

When knitting the instep 57, below line 60 in FIG. 11, the feeding of the hydrophobic additional terry yarn is discontinued and the feeding of the hydrophilic yarn is continued, but without forming terry loops to knit plain stitch fabric. The additional hydrophilic yarn, indicated at Y-2 in the left-hand portion of FIG. 13, is knit in plated relationship with the body yarns B and Y in the needle wale W-2 of courses C-94, C-95 and C-96, throughout the instep, down to the line 66. Below the line 66, the yarn Y-1 is knit with the body yarn in the thickened fabric area broadly indicated at 63, extending throughout the instep 57 and from the line 60 to the toe 55. The thickened fabric area 63 cushions and protects the upper portion of the foot of the wearer but does not include terry loops and is not as thick as the thickened fabric area 61 in the front portion 51 of the leg, where a greater amount of protection is desirable for preventing chafing and rubbing of the upper edge of the ski boot against the leg of the wearer.

When the ski sock of the present invention is knit on a circular hosiery knitting machine having 84 needles, as described in the first two embodiments, it is preferred that the thickened fabric area 61 in the front half 51 of the leg and the thickened fabric area 63 in the instep 57 be knit on the 26 needles which knit the front half 51 of the sock so that eight needles at each side of the thickened fabric areas 61, 63 do not form terry loops. It is also preferred that the thickened fabric area 62 in the heel 54 and the sole 56 be knit on the 42 needles which form the rear half of the sock so that the additional yarn extends to the center line 53. Thus, as indicated in FIG. 12, opposite side panels, broadly indicated at 64 and 65, are provided and are knit only of the body yarns Y and B. Since the opposite side panels 64, 65 are knit solely of the body yarns Y and B, they provide substantially greater stretchability than the stretchability of the adjacent thickened fabric areas 62, 63 and permit the sock to be readily drawn onto and off of the foot.

Figure 10:
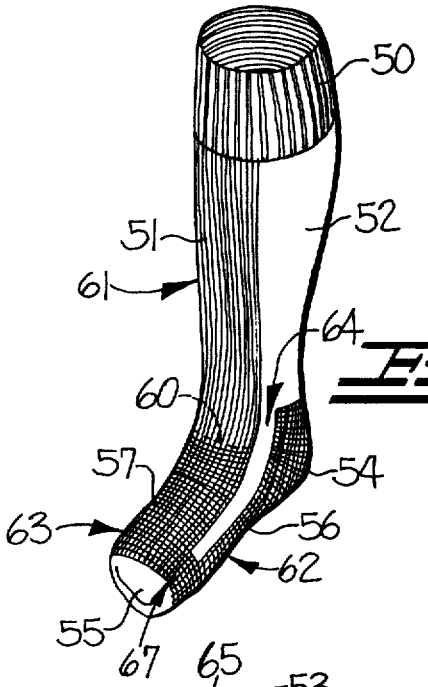
FIG. 10 is a perspective view of still another embodiment of the ski sock, as it appears when positioned on the leg and foot of the wearer.

In order to limit the stretchability of the lower portion of the foot, that portion extending back from the toe to about the medial portion of the ball of the foot, the additional yarn Y-1 is also knit in plated relationship with the body yarns Y and B in the lower portions of the opposite side panels 64, 65, as illustrated by the horizontal lines extending below a dash-dot line 66 in FIG. 11, to form stretch restricting opposite side panels, broadly indicated at 67 in FIGS. 10 and 11. Thus, the additional yarn Y-1 in the panels 67 limits stretchability in the area from about the middle of the ball of the foot and provides a snug fit on the forward end of the foot of the wearer.

Figure 14:
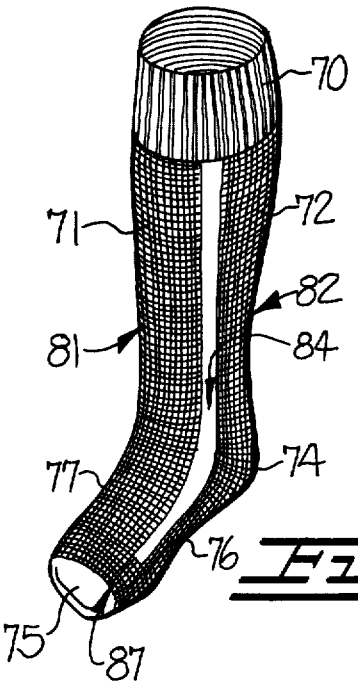
FIG. 14 is a perspective view of yet another embodiment of the ski sock, as it appears when positioned on the leg and foot of the wearer.
Figure 15:
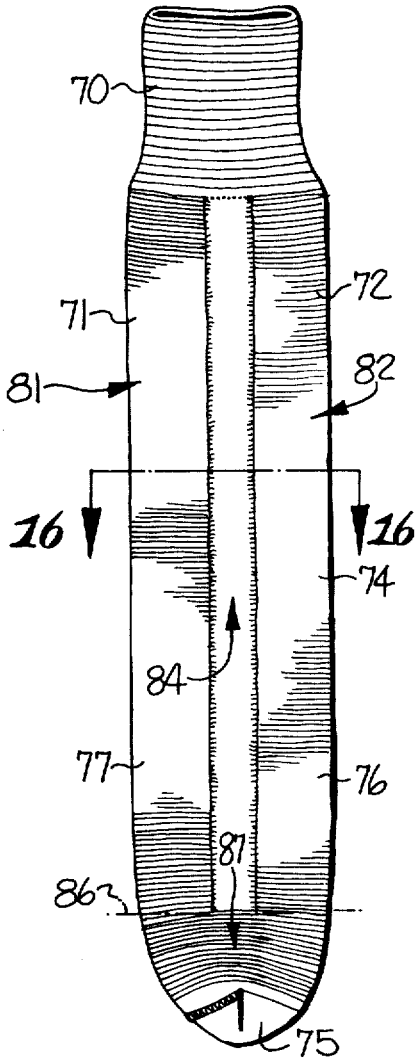
FIG. 15 is a side elevational view of the sock of FIG. 14, being shown in flattened and everted condition.
Figure 16:
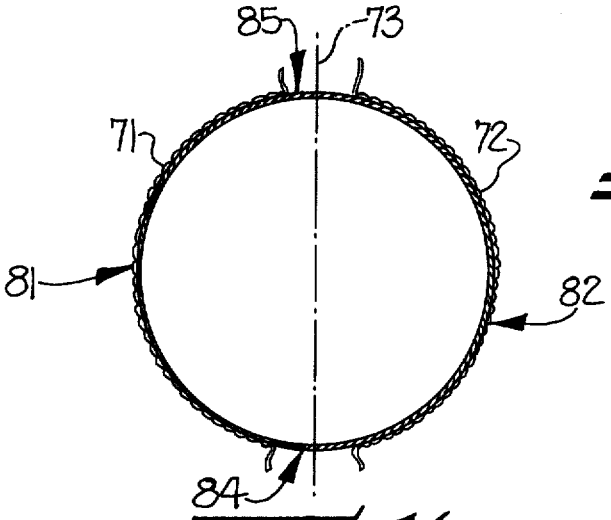
FIG. 16 is a somewhat schematic sectional view taken substantially along the line 16—16 in FIG. 15 and illustrating the sock in circular condition.

Embodiment of FIGS. 14–16

The ski sock of this embodiment is particularly adapted to be used by the professional skier having ski boots which are custom designed to fit the foot and leg of the wearer. These types of ski boots do not normally require as much padding or cushioning as is required by more amateur skiers, usually wearing ski boots which are not as well fitted. This ski sock includes an upper cuff 70 which may be of a true rib or mock rib construction and is integrally knit with the upper portion of the leg which includes a front half 71 and a rear half 72, illustrated in FIG. 16 as being divided by a center line 73. The leg is integrally knit with a foot including a heel area or portion 74, a toe 75, a sole 76, and an instep 77.

The leg and foot of the sock is knit throughout with a main body yarn knit in plated relationship with an auxiliary yarn. The body yarns are of the same type as the body yarns described in the preceding embodiments. An additional yarn is knit in plated relationship with the body yarns in the front half 71 of the leg to provide a cushioned thickened fabric area, broadly indicated at 81, extending from the cuff 70 and throughout the front portion of the leg and the instep 77 and down to the toe pocket 75. This additional yarn is knit with the body yarns in plated relationship and in the same manner as indicated in the lefthand portion of FIG. 9. This additional yarn is preferably a hydrophilic yarn, such as a blend of wool and silk, and is knit without forming terry loops to form plain stitch fabric in the thickened fabric area 81. When the sock is knit on an 84 needle machine, the thickened fabric area 81 terminates at opposite side edges three needles short of the center line 73. The thickened fabric area 81 is knit on the 36 needles which knit the medial portion of the front half 71 of the sock.

Another additional yarn is knit in plated relationship with the body yarns in the rear half 72 of the leg, the heel 74, and the sole 76 to provide a thickened fabric area, broadly indicated at 82, extending from the cuff 70 to the toe 75. This cushioned thickened fabric area 82 is knit in the same manner as the thickened fabric area 62 in the sock of FIG. 11. The additional yarn is knit in plated relationship with the body yarns in the same manner as indicated in the right-hand portion of FIG. 13, without forming terry loops, to form plain stitch fabric in the thickened fabric area 82. Opposite side edges of the thickened fabric area 82 terminate three needles short of the center line 73 (FIG. 16) so that only the body yarns are knit in panels in opposite sides of the sock.

Thus, opposite sides of the sock are provided with stretchable side panels, broadly indicated at 84 and 85, extending between opposite sides of the thickened fabric areas 81, 82. The thickened fabric area 81 extending down the front portion of the sock and the thickened fabric area 82 extending down the rear portion of the sock provide cushioning protection for the front portion of the leg, the instep, the rear portion of the leg, the heel and the sole of the wearer, without adding undue bulk to the sock. The stretchable opposite side panels 84, 85 provide sufficient stretchability to the sock so that it may be easily drawn onto and off of the foot and over the heel, and conform to the configuration of the leg and foot of the wearer.

In order to limit the stretchability of the lower portion of the foot, that portion extending back from the toe to about the medial portion of the ball of the foot, the additional yarn is knit in plated relationship with the body yarns in the lower portion of the opposite side panels 84, 85, as illustrated by the horizontal lines extending below the dash-dot line 86 in FIG. 15, to form stretch restricting opposite side panels, broadly indicated at 87 in FIGS. 14 and 15. The stretch restricting opposite side panels 87 limit the stretch in the area, from about the middle of the ball of the foot and provides a snug fit on the forward end of the foot of the wearer.

In each of the embodiments of the ski sock illustrated in the present application, additional yarn is knit in plated relationship with the body yarns and forms a thickened fabric area extending along at least the front portion of the leg of the sock to cushion and protect the front portion of the leg of the wearer from chafing and pressure exerted against the leg by the front and upper edge of the ski boot. Also, additional yarn is knit in plated relationship with the body yarns in the instep and the heel and sole areas of the sock to provide a thickened fabric area to cushion and protect the upper and lower portions of the foot of the wearer. The additional yarns are not knit in narrow panels extending down opposite sides of the leg of the sock to provide substantially greater stretchability than the stretchability of the adjacent thickened fabric areas to provide sufficient stretchability to the sock so as to permit the sock to be easily drawn onto and off of the foot and over the heel. It is preferred that the lower portion of the foot, that portion which extends from about the medial portion of the ball of the foot through the toes, includes an additional yarn knit with the body yarn to form stretch restricting panels to provide a snug fit on the forward end of the foot of the wearer.

It is to be understood that the width of the thickened fabric areas in the front and rear of the sock can be varied from that described in the four embodiments illustrated. However, the thickened fabric area in the front of the leg should be wide enough to protect the leg, at least more than one-fourth of the wales in the leg, and may be as wide as half the wales in the leg. The thickened fabric area in the rear of the leg, the heel, and sole must be wide enough to underlie the lower portion of the sole of the wearer and preferably encompass half of the wales of the sock or substantially half of the wales.

In the drawings and specification, there has been set forth the best modes presently contemplated for the practice of the invention, and although specific terms are employed, they are used in a generic and descriptive sense only and not for purposes of limitation, the scope of the invention being defined in the claims.

That which is claimed is:

1. A sock particularly adapted for wear with ski boots and the like and being adapted to cushion and protect the front portion of the leg from discomfort caused by the ski boot, said sock being knit throughout of at least one body yarn and including an integrally knit leg and foot, said leg and foot comprising a front half covering the front of the leg and the top of the foot of the wearer, and a rear half covering the rear of the leg, the heel, and the sole of the foot of the wearer, additional yarn knit in plated relationship with said body yarn in the front half of said leg and providing a thickened fabric area extending along the front of the leg of the wearer, areas adjacent opposite sides of said thickened fabric area in the front half of said leg being knit of said body yarn only, said thickened fabric area in said front half of said leg cushioning and protecting the front of the leg of the wearer, and said body yarn areas adjacent opposite sides of said thickened fabric area providing substantially greater stretchability than the stretchability of said thickened fabric area so that the sock may be easily drawn on and removed from the foot and leg of the wearer and the sock will readily conform to the configuration of the leg of the wearer.

2. A sock according to claim 1 wherein said additional yarn forms terry loops in said thickened fabric area in said front half of said leg.

3. A sock according to claim 2 including a second additional yarn forming a second set of terry loops in said thickened fabric area in said front half of said leg.

4. A sock according to claim 1 wherein the entire rear half of said leg is knit of said body yarn only.

5. A sock according to claim 1 wherein said thickened fabric area in the front of the leg encompasses less than half of the wales in the leg and more than one-fourth of the wales in the leg.

6. A sock according to claim 1 including additional yarn knit in plated relationship with said body yarn in said rear half of said leg and providing a thickened fabric area extending along the rear of the leg of the wearer, and wherein said body yarn areas adjacent opposite sides of said thickened fabric area in said front half of said leg extend between said thickened fabric areas in said front and rear halves of said leg and define opposite side panels of substantially greater stretchability than the stretchability of said thickened fabric areas in said front and rear halves of said leg, said opposite side panels providing sufficient stretchability in said leg to permit the sock to be easily drawn onto and off of the foot and to cause the leg of the sock to readily conform to the configuration of the leg of the wearer.

7. A sock according to claim 6 wherein said additional yarns in said thickened fabric areas in said front and rear halves of said leg are knit in plated relationship with said body yarn to form plain stitch fabric.

8. A sock according to claim 7 wherein said additional yarns in said thickened fabric areas in said front and rear halves of said leg are cut at opposite sides of said thickened fabric areas and extend inside of said leg of said sock and adjacent opposite sides of said opposite side panels.

9. A sock particularly adapted for wear with ski boots and the like and being adapted to cushion and protect the front portion of the leg from discomfort caused by the ski boot, said sock being knit throughout of at least one body yarn and including an integrally knit leg and foot, said leg and foot comprising a front half covering the front of the leg and the top of the foot of the wearer, and a rear half covering the rear of the leg, the heel, and the sole of the foot of the wearer, additional yarn knit in plated relationship with said body yarn and forming terry loops in the front half of said leg and providing a thickened fabric area extending along the front of the leg of the wearer, areas adjacent opposite sides of said thickened fabric area in the front half of said leg being devoid of terry loops and providing thinner fabric areas, said thickened fabric area in said front half of said leg cushioning and protecting the front of the leg of the wearer, and said thinner fabric areas adjacent opposite sides of said thickened fabric area providing reduced bulk in the leg of the sock.

10. A sock according to claim 9 wherein the entire rear half of said leg is devoid of terry loops.

11. A sock particularly adapted for wear with ski boots and the like and including a leg and foot knit throughout of at least one body yarn, said leg comprising front and rear halves, said foot including a heel and a sole aligned with said rear half of said leg, and an instep aligned with said front half of said leg, additional yarn knit in plated relationship with said body yarn and forming an area of thickened fabric extending along said front half of said leg and said instep, and additional yarn knit in plated relationship with said body yarn and forming an area of thickened fabric extending along said heel and said sole, said thickened fabric area in said instep being narrower than said front half of said sock, and said thickened fabric areas defining opposite side panels between said thickened fabric area in said instep and said thickened fabric area in said heel and said sole, said opposite side panels being knit of said body yarn only and providing substantially greater stretchability than the stretchability of said thickened fabric areas in said instep, said heel and said sole, the stretchability of said opposite side panels providing sufficient stretchability in the foot of the sock to permit the sock to be easily drawn onto and off of the foot of the wearer.

12. A sock according to claim 11 wherein said additional yarn forms terry loops in said thickened fabric area in said front half of said leg, and wherein said additional yarn forms terry loops in said thickened fabric area in said instep.

13. A sock according to claim 12 wherein said additional yarn forms two sets of terry loops in said thickened fabric area in said front half of said leg, and wherein said additional yarn forms a single set of terry loops in said thickened fabric area in said instep.

14. A sock according to claim 11 wherein said additional yarn forms terry loops in said heel and sole.

15. A sock according to claim 11 wherein said additional yarn forms terry loops in said thickened fabric area in said front half of said leg, and wherein said additional yarn in said instep is knit in plated relationship with said body yarn to form plain stitch fabric.

16. A sock according to claim 11 wherein said additional yarn is knit in plated relationship with said body yarn in said instep to form plain stitch fabric, and wherein said additional yarn forms terry loops in said heel and sole.

17. A sock according to claim 11 wherein said additional yarn is knit in plated relationship with said body yarn in said instep to form plain stitch fabric, and wherein said additional yarn is knit in plated relationship with said body yarn in said heel and sole to form plain stitch fabric.

18. A sock according to claim 11 wherein said thickened fabric area in said heel and said sole encompasses less than half of the wales in said foot.

19. A sock according to claim 11 wherein said thickened fabric area in said heel and said sole encompasses one half of the wales in said foot.

20. A sock according to claim 11 wherein said thickened fabric area in the front half of said leg and said thickened fabric area in said instep are the same width and join each other so that a thickened fabric area extends along the entire length of the front of the sock.

21. A sock according to claim 11 wherein additional yarn is knit in plated relationship with said body yarn in the portions of said opposite side panels adjacent said toe to form stretch restricting panels therein, said stretch restricting panels limiting stretchability of the forward end of the foot of the sock to provide a snug fit on the forward end of the foot of the wearer.

22. A sock according to claim 11 including additional yarn knit in plated relationship with said body yarn and forming a thickened fabric area extending along said rear half of said leg, and wherein said opposite side panels extend between said thickened fabric areas in said front and rear halves of said leg.

23. A sock including a leg and foot knit throughout of at least one body yarn, said foot comprising a rear half including a heel and sole, and a front half including an instep, a first area of thickened fabric extending longitudinally along said instep and including opposite side edges, a second area of thickened fabric extending longitudinally along said heel and sole and including opposite side edges, said first and second thickened fabric areas limiting the stretchability of the corresponding portions of said instep and said heel and sole of the foot of the sock, opposite side edges of said first area of thickened fabric being spaced from opposite side edges of said second area of thickened fabric and defining opposite side panels extending longitudinally between said thickened fabric areas in said instep and said heel and sole, said opposite side panels having substantially greater stretchability than the limited stretchability of said thickened fabric areas in said instep and said heel and sole, and the stretchability of said opposite side panels providing sufficient stretchability in the foot of the sock to permit the sock to be easily drawn onto and off of the foot of the wearer.

24. A sock according to claim 23 wherein an additional yarn is knit in plated relationship with said body yarn to form said areas of thickened fabric extending along said instep, and said heel and said sole.

25. A sock according to claim 23 wherein said thickened fabric area in said instep is narrower than said front half of said foot.

26. A sock according to claim 24 wherein said opposite side panels are knit of said body yarn only.

27. A sock according to claim 23 wherein additional yarn is knit in plated relationship with said body yarn in the portions of said opposite side panels adjacent said toe to form stretch restricting panels therein, said stretch restricting panels limiting stretchability of the forward end of the foot of the sock to provide a snug fit on the forward end of the foot of the wearer.

28. A sock according to claim 23 wherein said additional yarn forms terry loops in said thickened fabric area in said instep, and wherein said additional yarn forms terry loops in said thickened fabric area in said heel and sole.

29. A sock according to claim 23 wherein said additional yarn is knit in plated relationship with said body yarn in said instep to form plain stitch fabric, and wherein said additional yarn forms terry loops in said heel and sole.

30. A sock according to claim 23 wherein said additional yarn is knit in plated relationship with said body yarn in said instep to form a plain stitch fabric, and wherein said additional yarn is knit in plated relationship with said body yarn in said heel and sole to form plain stitch fabric.

* * * * *